US009724958B1

(12) United States Patent
Okoli et al.

(10) Patent No.: US 9,724,958 B1
(45) Date of Patent: Aug. 8, 2017

(54) FINIAL

(75) Inventors: Chukwunonso Okoli, Roswell, GA (US); Neil Varlamoff, Acworth, GA (US); Troy T. Miller, Cumming, GA (US)

(73) Assignee: LEVOLOR, INC., Atlanta, GA (US)

( * ) Notice: Subject to any disclaimer, the term of this patent is extended or adjusted under 35 U.S.C. 154(b) by 265 days.

(21) Appl. No.: 13/455,673

(22) Filed: Apr. 25, 2012

(51) Int. Cl.
*B44C 5/00* (2006.01)
*B44C 5/04* (2006.01)

(52) U.S. Cl.
CPC ..... *B44C 5/00* (2013.01); *B44C 5/0461* (2013.01)

(58) Field of Classification Search
USPC ..... 428/28
See application file for complete search history.

(56) References Cited

U.S. PATENT DOCUMENTS

D77,958 S * 3/1929 Helvey ..... D26/67
D100,811 S * 8/1936 Bick ..... D26/67
2,059,314 A * 11/1936 Chilo ..... 403/25
D102,553 S * 12/1936 Gosling ..... D26/67
D178,282 S * 7/1956 Runtz ..... D26/67
D230,948 S * 3/1974 Moon ..... D8/376
D389,041 S * 1/1998 Smiley et al. ..... D8/378
D415,675 S * 10/1999 Hannerstig et al. ..... D8/378
D492,582 S * 7/2004 Graves et al. ..... D8/378
D507,964 S * 8/2005 File et al. ..... D8/378
D533,444 S * 12/2006 Zoroufy ..... D8/378
D551,479 S * 9/2007 Gilbert ..... D6/524
D600,391 S * 9/2009 Sabernig ..... D26/67
D673,728 S * 1/2013 Cartwright ..... D26/142
2006/0272585 A1* 12/2006 O'Dell ..... 119/57.8

OTHER PUBLICATIONS

Nuts and Washer. The Home Depot. 2013, pp. 1-4.*

* cited by examiner

*Primary Examiner* — D. Lawrence Tarazano
*Assistant Examiner* — Stephanie Cox
(74) *Attorney, Agent, or Firm* — Dority & Manning, P.A.

(57) ABSTRACT

A finial comprises a body having a first end and a second end. A collar is attached to the first end using a first releasable connector. A crown is attached to the second end using a second releasable connector where the second releasable connector is independent from the first releasable connector. The body, crown and collar define an interior space where the interior space is open and unobstructed between the crown and the collar.

22 Claims, 5 Drawing Sheets

FINIAL

BACKGROUND

A window covering such as a curtain, drapery, shade or similar covering may be supported by a curtain rod. The window covering may be suspended directly from the rod or it may be suspended from intervening elements such as rings, hooks or the like. Further, the curtain rod may include mechanisms for opening and closing the window covering. Decorative finials may be provided on the ends of the rod to provide ornamentation. Existing finials having a center support rod or bolt that passes through the middle of the framework to secure the finial components together have been found to detract from the decorative style and aesthetics of open framework type finials. While welded solutions exist, welding of a decorative component such as a finial also has a negative impact on the aesthetics of the finial and the perception of overall quality. Welding also adds substantial manufacturing complexity.

SUMMARY OF THE INVENTION

A finial comprises a body having a first end and a second end. A collar is attached to the first end using a first releasable connector. A crown is attached to the second end using a second releasable connector where the second releasable connector is independent from the first releasable connector. The body, crown and collar define an interior space where the interior space is open and unobstructed between the crown and the collar.

The collar may comprise an inner end that engages the body and an outer end that is adapted to be engaged by a rod. The inner end may define a seat for receiving the body. The collar may comprise an outer section that is secured to an inner section where the inner section is adapted to be engaged by a rod. The body may comprise a see through structure. The see through structure may comprise an open framework. The open frame work may comprise a plurality of solid structural members and a plurality of voids between the plurality of structural members. The see through structure may comprise at least one of a transparent and a translucent material. The body may comprise a plurality of separate body components that together define the body. The first releasable connector may comprise a first clamping mechanism where a portion of the body is clamped by a portion of the collar. The body may comprise a seat that is disposed opposite to the collar and a collar washer that abuts the seat. The seat may extend at least partially about the internal periphery of the body. A first engagement structure on the collar washer may be engaged by a second engagement structure on the collar to prevent the collar washer from rotating relative to the collar. The collar may comprise an outer section and an inner section, and a fastener may engage the collar washer to secure the collar washer to the collar such that a portion of the body is clamped between the collar and the collar washer and to secure the inner section to the outer section. A fastener may engage the collar washer to secure the collar washer to the collar such that a portion of the body is clamped between the collar and the collar washer. The fastener may comprise a screw post having a first portion and a second portion, the first portion comprising screwthreads and being inserted through an aperture in the collar and threadably engaging a threaded member formed on the collar washer such that the collar washer tightly clamps the body against the collar. The second portion of the fastener may define a connector that is adapted to engage a curtain rod to mount the finial to the curtain rod. The second releasable connector may comprise a second clamping mechanism where a portion of the body is clamped by a portion of the crown. The body may comprise a second seat that is disposed opposite to the crown, a crown washer that abuts the second seat, and a fastener that engages the crown washer to secure the crown washer to the crown such that a second portion of the body is clamped between the crown and the crown washer. The second seat may extend at least partially about the internal periphery of the body.

A finial comprises a body having a first end and a second end. A collar is attached to the first end using a first mechanism comprising a first portion of the collar trapped at least in part by a portion of the body. A crown is attached to the second end using a second mechanism comprising a first portion of the crown trapped at least in part by a second portion of the body where the second mechanism is independent from the first mechanism. The body, crown and collar define an interior space where the interior space is open and unobstructed between the crown and the collar.

A method of making a finial comprises providing a body having a first end and a second end; seating a crown on the first end; releasably connecting the first end of the body to the crown; seating a collar on the second end; releasably connecting the second end of the body to the collar. The method may further comprise attaching the finial to a rod.

A finial comprises a body having a first end and a second end. A collar is attached to the first end using a first releasable connector where a first portion of the collar is trapped at the first end of the body. A crown is attached to the second end using a second releasable connector where a first portion of the crown is trapped at the second end of the body where the second releasable connector is independent from the first releasable connector. The body, the crown and the collar define an interior space where the interior space is open and unobstructed between the first end of the body and the second end of the body.

DETAILED DESCRIPTION OF EMBODIMENTS OF THE INVENTION

Figure 1:
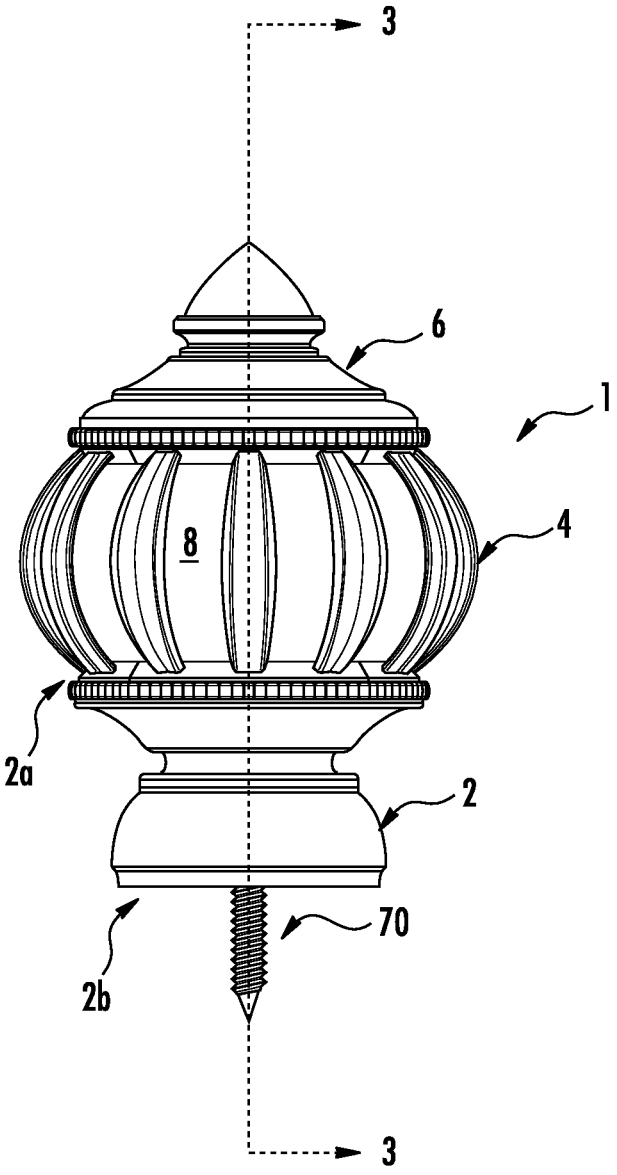
FIG. 1 is a side view of an embodiment of a finial of the invention.
Figure 2:
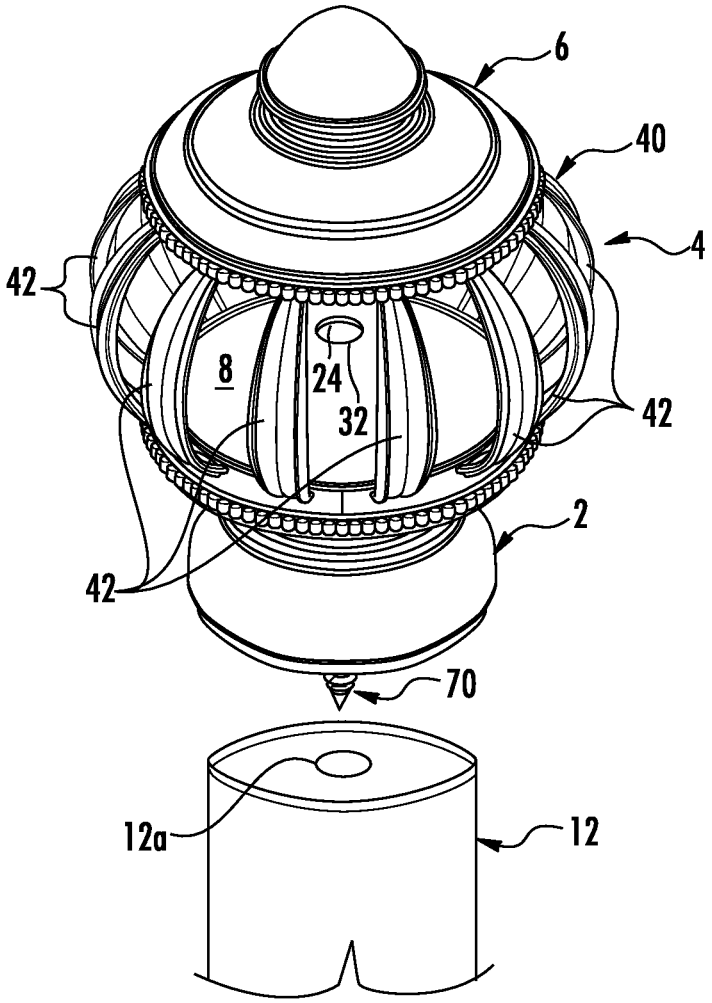
FIG. 2 is a perspective view of the embodiment of the finial of FIG. 1.
Figure 3:
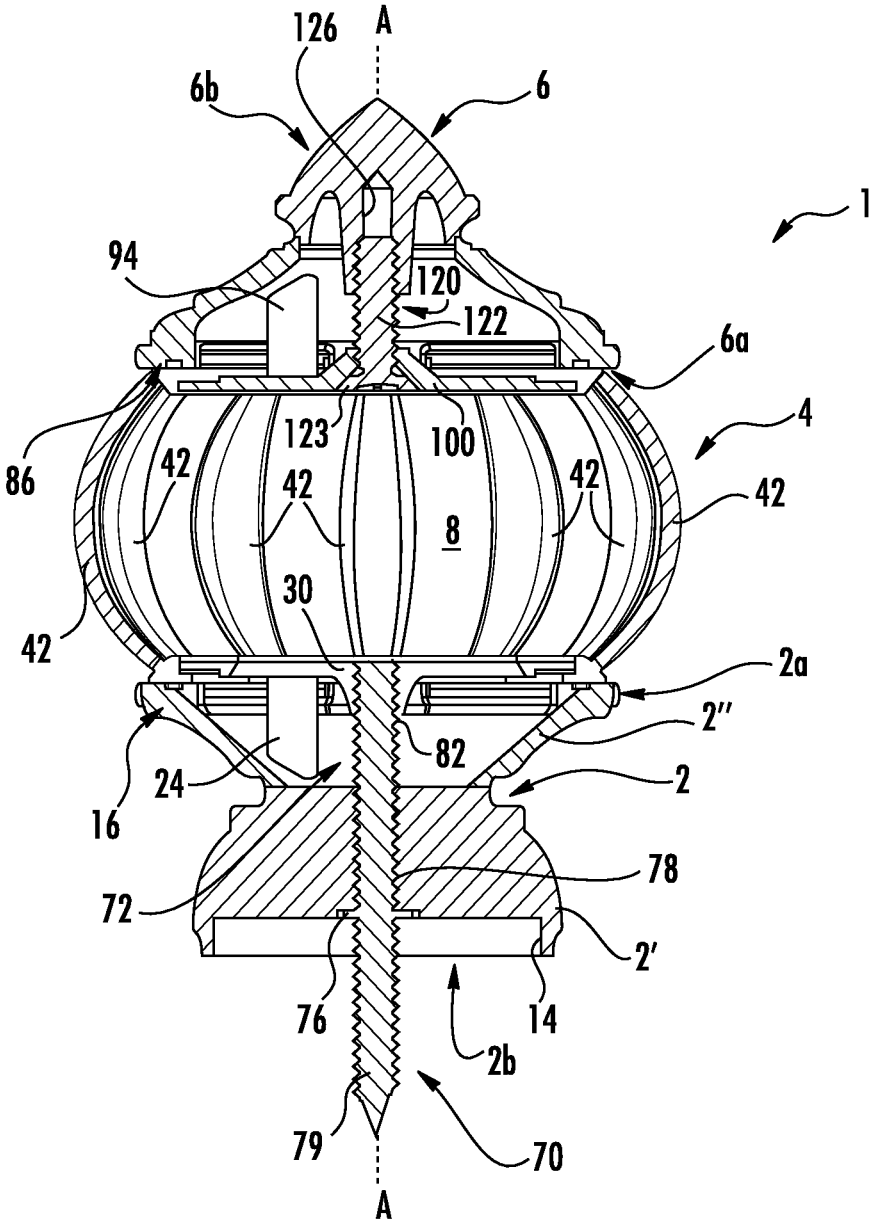
FIG. 3 is a section view taken along line 3-3 of FIG. 1.

The finial of the invention provides a decorative ornamentation for a rod or other similar structure where the rod may be used to support a window covering such as a curtain, drapery, shade or similar window covering. The rod may comprise a wide variety of configurations, structures, materials, finishes and decors. The decorative appearance of the finial may vary significantly from that shown in the figures. The decorative appearance of the finial may be selected to match a wide variety of decors and may be provided with a wide variety of finishes, colors, materials, shapes, sizes, and ornamentations.

The finial described herein does not use an internal support structure such as a center support rod such that the interior space of the finial is an unobstructed, open space.

The embodiments described herein provide a unique solution for a finial with an open void or space throughout the interior of the finial that is simple to manufacture, eliminates the use of a connecting structure extending through the open space and maintains the desired decorative aesthetics. Providing an unobstructed, open interior space has particular application where the interior of the finial is visible because the open interior provides enhanced aesthetics. The finial has particular application to finials having an open framework, transparent or translucent structures. As used herein the term "see through" refers to a finial structure where the outer surface or surfaces of the finial allows visibility into or through the finial and includes open framework or lattice structures, transparent materials, translucent materials, or combinations of such structures and materials. While the finial of the invention has particular application to see through structures the finial may also be used with opaque structures. The structure and assembly method of the finial provides a finial assembly that is simple and inexpensive to manufacture and that may be used with a wide variety of materials. To achieve the complete open void or space in the finial, while still providing simplified efficient manufacturing, the finial uses a releasable or removable connection or coupling between the major finial components. For example, a finial's crown or end cap can be releasably connected or coupled to the final's main body and the finial's collar may likewise be releasably connected or coupled to the opposite end of the finial's main body. During manufacturing or other assembly process, instead of permanently affixing the crown and/or collar to the main body, such as by welding, and instead of passing a bolt, post or other securing mechanism through the center of the finial's main body, the main body provides the structure between the crown and collar where the crown and collar each are attached to an opposite end of the main body in a releasable or non-permanent manner. Connecting or coupling the crown to one end of the finial body and the collar to an opposite end of the finial body also permits the body to be manufactured in multiple sub-components where the body sub-components are assembled and coupled together by the crown and collar. Accordingly, the example embodiments described in more detail herein provide an improved finial appearance, allowing for an unobstructed and see-through open space between the collar and the crown, while maintaining cost-effective and simple manufacturing techniques.

Referring to FIGS. 1-4, an embodiment of a finial is shown generally at 1 comprising a collar 2, a body 4 and a crown or end cap 6. The collar 2 is secured to one end of the body 4 using a first releasable connector and the crown 6 is secured to the other end of the body 4 using a second releasable connector. As used herein the term "releasable connector" may generally refer to a connection means that can be assembled (for example by using mechanical techniques) in a non-permanent manner, in contrast to a permanent connection such as welding or single piece die-casting. The term "releasable" does not require that the connection or coupling be intended for release or disassembly after manufacture of the finial. The collar 2 and crown 6 are secured to the body 4 without using a structure interior of the body 4 that obstructs the open interior space 8 or that spans the collar 2 and crown 6, such as a center support rod. As a result, the interior space 8 defined by the collar 2, crown 4 and body 6 is an unobstructed, open space without any visible internal support structure extending through or across the space. The assembled finial 1 may be connected to a rod such as a curtain rod 12. Typically, one finial will be attached to each end of the rod 12.

The collar 2 comprises an inner end 2*a* that is engaged by body 4 and an outer end 2*b* that faces and/or engages the rod 12. The outer end 2*b* may be dimensioned and configured to mate with the rod 12 such that a close fit is provided between the rod and the finial. In one embodiment the outer end 2*b* comprises a recess 14 that is shaped and dimensioned to receive the end of the rod 12. The inner end 2*a* defines a seat 16 for receiving the body 4 such that the body 4 may be properly positioned on the collar 2. In the illustrated embodiment the seat 16 is defined by an external flange 18 and a plurality of spaced internal flanges 20. A transverse member 21 extends radially outwardly from each of the internal flanges 20. Seat 16 receives the inner rim 46 of body 4 to support the body on the collar 2 as will hereinafter be described. While the finial as shown has a round shape the finial may also have a rectilinear shape and the seat 16 may have a corresponding rectilinear shape, rather than the annular shape as shown. The crown 6 is formed with a seat 86 that is substantially identical to seat 16 on collar 2.

An engagement structure 24 is formed on the collar 2 that faces toward the body 4 and engages a mating engagement structure 32 on the collar washer 30 to prevent the collar washer 30 from rotating during assembly of the finial. In one embodiment the engagement structure 24 comprises a post and engagement structure 32 comprises an aperture that is dimensioned to closely receive the post. The post and aperture may be reversed such that the post is formed on the washer 30 and the aperture is formed on the collar 2. Further, structures other than a single post and aperture may be used as the mating engagement structures. For example, any arrangement of a male engagement structure on one of the collar and washer and a mating female engagement structure on the other of the collar and washer may be used. Moreover, where the finial has other than a round shape, the engagement of the non-round collar washer with the non-round body 4 may prevent the rotation of the collar washer relative to the collar without the use of a separate engagement structure. In such an arrangement the mating non-round shapes act as the engagement structures to prevent rotation of the collar washer.

In one embodiment the collar 2 may be formed as a unitary, one-piece member. In the illustrated embodiment the collar 2 is formed of two pieces that are coupled together to form the collar 2 in the assembled finial. The collar 2 comprises an outer section 2' that abuts with and is secured to an inner section 2" in the assembled finial. The use of a two-piece collar allows the collar to be more easily manufactured in a variety of complex ornamental shapes and size. With a two-piece collar mating structures may be provided to provide a secure connection between the components. For example, inner section 2" may be provided with an aperture 31 that fits over an annular seat 33 formed on the outer section 2'. An axially aligned bore 78 is formed in the collar 2 that communicates the exterior of the collar with the interior of the body 4.

Figure 4:
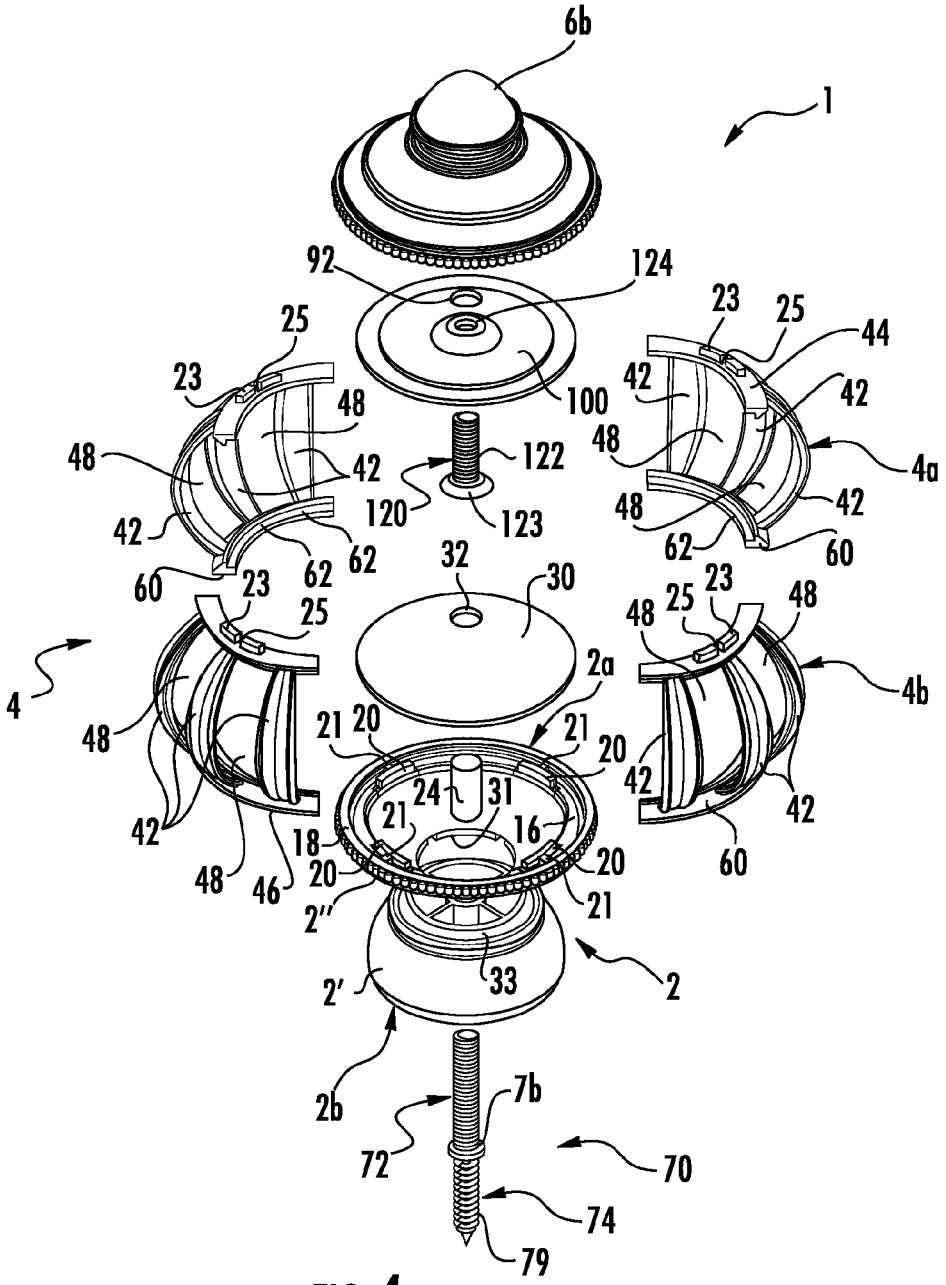
FIG. 4 is an exploded view of the embodiment of the finial of FIG. 1.
Figure 5:
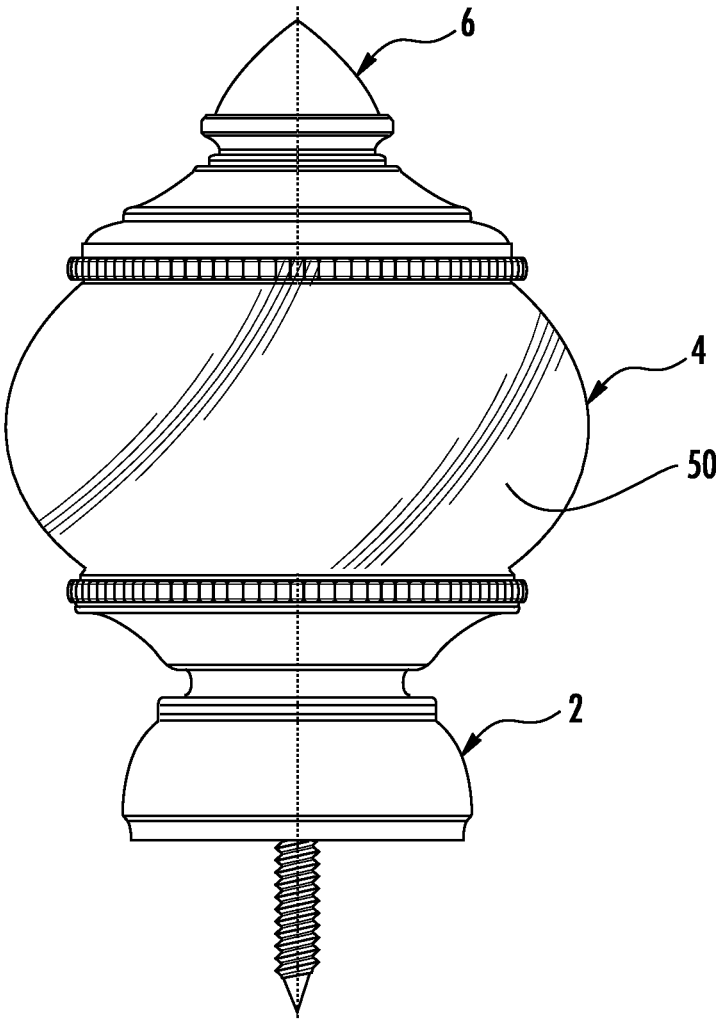
FIG. 5 is a side view of another embodiment of a finial of the invention.

The body 4 comprises an ornamental structure that is secured to and extends between the collar 2 and the crown 6. In one embodiment, the body 4 comprises a see through structure such as an open framework 40 or a transparent or translucent globe 41. The open frame work 40 (FIGS. 1-4) may comprise a plurality of solid structural members 42 that extend between the outer rim 44 and the inner rim 46 with voids or open areas 48 formed between or through the members 42. The voids may be filled with a transparent or translucent material if desired. While one embodiment of the arrangement of structural members and voids is illustrated, the body may have any shape and configuration and the structural members may define a lattice structure or other open framework. In the illustrated embodiment, the body 4 is made of a plurality of separate body components 4*a*, 4*b*, 4*c* and 4*d* that together define the body 4; however, the body 4 may be formed as one-piece. Use of the separate components to make the body 4 may make the manufacture of complex shapes easier and may facilitate the assembly of the finial. Referring to FIG. 5, body 4 comprises a globe 50 made of transparent or translucent material where the interior of the finial is visible through the solid globe.

The inner rim 46 of body 4 is shaped and dimensioned to fit into the seat 16 formed on collar 2. The outer rim 44 and inner rim 46 of the body 4 are substantially identical such that reference will be made to outer rim 44 as shown in FIG. 4. The rim includes a plurality of axially extending flanges 23 each having a transverse slot 25 that is dimensioned to receive the transverse member 21 of seat 16. Each of the flanges 23 may be positioned between external flange 18 and one of the internal flanges 20 with the transverse member 21 extending into the slot 25 such that the body 4 is properly seated on and in a fixed position relative to collar 2.

The inner rim 46 comprises an inwardly extending ledge or flange 60 that creates a seat 62 that is disposed opposite to the collar 2 and that extends substantially perpendicular to the longitudinal axis A-A of the finial 1. When the body 4 is located on the collar 2 the seat 62 creates a substantially annular platform that extends about the internal periphery of the body 4 and receives the collar washer 30 such that the collar washer 30 abuts the seat 62. While the seat 62 is shown and described as an annular seat that extends about the internal periphery of the body 4, the seat 62 may also comprise a plurality of discrete components spaced from one another about the periphery of the body 4. Moreover, where the finial has a rectilinear shape, the seat 62 may also have a rectilinear shape. Further, while in a preferred embodiment the shape of seat 62 corresponds to the shape of the finial, the shape of the seat may be different from the shape of the finial. For example, a round finial may be supported on a rectilinear seat.

The collar washer 30 abuts the seat 62 and is oriented such that the engagement structure 32 on washer 30 is engaged by the engagement structure 24 formed on the collar 2. In the illustrated embodiment the post 24 formed on the collar 2 is inserted into the aperture 32 formed on the washer 30. The engagement of the post with the aperture prevents the washer 30 from rotating relative to the collar 2. The collar washer 30 may have a shape that corresponds to the shape of the rim 46 of body 4 such that where the rim has a circular shape the collar washer also has a circular shape. Where the finial has a rectilinear shape, the collar washer 30 may also have a rectilinear shape. While in the illustrated embodiment the collar washer 30 fills the bottom area of the body 4 defined by the inner rim 46 the washer 30 may extend for less than the entire area provided it engages the seat 62 sufficiently to secure the body 4 to the collar 2.

A fastener 70 engages the collar washer 30 to secure the collar washer to the collar 2 such that the seat 62 of body 4 is trapped between the collar washer 30 and collar 2 to create an integrated assembly. If a two-piece collar is used the fastener 70 also secures the collar portions 2', 2" to one another. In one embodiment the fastener 70 comprises a screw post having a first portion 72 and a second portion 74 separated by a flange 76. The first portion 72 may comprise a threaded member that is inserted through axially aligned bore 78 formed in the collar 2. The fastener 70 is inserted from outside the finial along the longitudinal axis of the finial such that it threadably engages a threaded hole 82 formed on the washer 30. While the first portion 72 is shown as comprising a male threaded member that engages a female threaded hole formed on the washer, the fastener 70 may comprise the female receptacle that is engaged by a male connector on the washer. Further, the connection between the washer 30 and the fastener 70 may be made by other than a threaded connection. For example a snap fit connector may be used. The use of a threaded connection allows the washer 30 and fastener 70 to be tightly secured to one another to tightly clamp the ledge 60 of the body 4 between the washer 30 and the collar 2. When the fastener 70 is tightened to the washer 30 the flange 76 engages the collar 2 such that fastener 70 pulls the collar washer 30 tight against the seat 62 of the body 4 to clamp the ledge 60 of the body 4 between the collar 2 and the washer 30. In this embodiment the engagement of the collar washer 30 when it is pulled tight against the seat 62 of the body 4 to clamp the ledge 60 of the body 4 between the collar 2 and the washer 30 forms a first releasable connector. While a specific embodiment of the first releasable connector is shown the first releasable connector may have other configurations. For example, the body 4 may be secured to the collar 2 using a snap-fit connection where a portion of one of the collar or body is mechanically engaged by a portion of the other one of the collar or body. The portions of the body and/or collar may elastically deform to make the snap-fit connection. The body 4 may also be secured to the collar 2 using a pressure or friction fit connection where a portion of one of the collar or body frictionally engages a portion of the other one of the collar or body. The releasable connector may also comprise mating screwthreads formed on the collar 2 and body 4. In the various embodiments of the first releasable connector a portion of the collar is connected to a portion of the first end of the body such that the connection is made at one end of the body where the connection does not interfere with or obstruct the open space or void of the body.

The second portion 74 of fastener 70 defines a connector 79 that engages the curtain rod 12 to mount the finial 1 to the rod 12. In the illustrated embodiment the connector 79 comprises screwthreads that may threadably engage a threaded hole 12*a* formed on the rod 12. While connector 79 is shown comprising a threaded member is shown as connector, the connector 79 may comprise any structure that may be used to secure the finial 1 to the rod 12 and may comprise a snap fit connector, female threaded receptacle or the like in place of the male screwthreads 79. Connection of the finial to the rod also may be accomplished using a device other than fastener 70. For example, recess 14 may be provided with internal screwthreads that mate with external screwthreads formed on the exterior of rod 12. In this embodiment, connector 79 may be eliminated and fastener 70 may comprise a screw having a head in place of flange 76.

A similar structure secures the crown 6 to the distal end of the body 4. The crown 6 comprises an interior side 6*a* that is engaged by body 4 and an exterior side 6*b*. The exterior side 6*b* may be configured to have any style and shape. The interior side 6*a* defines a seat 86 for receiving the body 4 such that the body 4 may be properly positioned relative to the crown 6. In the illustrated embodiment the seat 86 is substantially identical to seat 16 on the collar 2. An engagement structure 94 is formed on the crown 6 that faces toward the body 4 and engages a mating engagement structure 92 on the crown washer 100 to prevent the crown washer 100 from rotating. In one embodiment the engagement structure 94 comprises a post and the engagement structure 92 comprises an aperture. The post and aperture may be reversed such that the post is formed on the washer 100 and the aperture is formed on the crown 6. Further, structures other than a single post and aperture may be used as the mating engagement structures. For example, any arrangement of a male engagement structure on one of the collar and washer and a mating female engagement structure on the other of the collar and washer may be used. Moreover, where the finial has other than a round shape, the engagement of the non-round crown washer with the non-round body may prevent the rotation of the crown washer relative to the crown without the use of a separate engagement structure. In such an arrangement the mating non-round shapes act as the engagement structures to prevent rotation of the crown washer relative to the crown.

The body comprises a outer rim 44 that is shaped and dimensioned to engage the seat 86 formed on crown 6. The outer rim 44 comprises an inwardly facing ledge or rim 106 that creates a seat 108 that is disposed opposite to the crown 6 and that extends substantially perpendicular to the longitudinal axis A-A of finial 1. When the crown 6 is located on the body 4 the seat 108 creates a substantially annular platform that extends about the internal periphery of the body 4 and receives the crown washer 100 such that the crown washer 100 abuts the seat 108. While the seat is shown and described as an annular seat that extends about the periphery of the body, the seat may also comprise a plurality of discrete elements spaced from one another about the periphery of the body 4. While the finial as shown has a round shape the finial may also have a rectilinear shape such that the seat 86 and washer 100 will also have a corresponding rectilinear shape. Further, while in a preferred embodiment the shape of seat 108 corresponds to the shape of the finial, the shape of the seat may be different from the shape of the finial. For example, a round finial may be supported on a rectilinear seat.

The crown washer 100 abuts the seat 108 and is oriented such that the engagement structure 92 on washer 100 engages the engagement structure 94 formed on the crown 6. In the illustrated embodiment the post 94 formed on crown 6 is inserted into the aperture 92 formed on crown washer 100. The engagement of the post with the aperture prevents the crown washer 100 from rotating relative to the crown 6. The post and aperture may be reversed such that the post is formed on the crown washer 100 and the aperture is formed on the crown 6. Further, structures other than a single post and aperture may be used as the mating engagement structures. For example, any arrangement of a male engagement structure on one of the crown and crown washer and a mating female engagement structure on the other of the crown and crown washer may be used. Moreover, where the finial has other than a round shape, the engagement of the non-round crown washer with the non-round body 4 may prevent the rotation of the crown washer relative to the crown without the use of a separate engagement structure. In such an arrangement the mating non-round shapes act as the engagement structures to prevent rotation of the crown washer relative to the crown.

A fastener 120 engages the crown washer 100 to secure the washer 100 to the crown 6 such that the body 4 is trapped between the crown 6 and washer 100 to create an integrated assembly. In one embodiment the fastener 120 comprises a screw having a threaded post 122 that is inserted from inside the finial through an aperture 124 in the crown washer 100 and into a mating threaded bore 126 on the crown 6. By inserting fastener 120 from inside the finial the fastener is hidden from view and does not affect the aesthetics of the crown. While the fastener 120 is shown as comprising a male threaded member that engages a female threaded bore formed on the crown 6, the fastener 120 may comprise the female receptacle that is engaged by a male connector on the crown. Further, the connection between the crown and the faster may be made by other than a threaded connection. For example a snap fit connector may be used. The threaded connection allows the crown and fastener to be tightly secured to one another to tightly clamp the platform 106 of the body 4 between the washer 100 and the crown 6. When the fastener 120 is tightened against the washer 100 the head 122 of fastener 120 engages the crown washer 100 such that fastener 120 pulls the crown washer 100 tight against the seat 108 to clamp the ledge 106 of the body 4 between the crown 6 and the crown washer 100. In this embodiment the engagement of the crown washer 100 when it is pulled tight against the seat 108 of the body 4 to clamp the ledge 106 of the body 4 between the crown 6 and the washer 100 forms a second releasable connector. While a specific embodiment of the second releasable connector is shown the second releasable connector may have other configurations. For example, the body 4 may be secured to the crown 6 using a snap-fit connection where a portion of one of the crown or body is mechanically engaged by a portion of the other one of the crown or body. The portions of the body and/or crown may elastically deform to make the snap-fit connection. The body 4 may also be secured to the crown 6 using a pressure or friction fit connection where a portion of one of the crown or body frictionally engages a portion of the other one of the crown or body. The releasable connector may also comprise mating screwthreads formed on the crown 6 and body 4. In the various embodiments of the second releasable connector a portion of the crown is connected to a portion of the second end of the body 4 such that the connection is made at the opposite end of the body from the first connector. Because the first connector and the second connector are connected only at the first end of the body and the second end of the body, respectively, the two connections do not interfere with or obstruct the open space or void of the body.

Between the crown 6 and the collar 2, the body 4 defines an internal space 8 that is visible to the user when a see through body is used. The separate and independent clamping mechanisms between the crown 6 and the body 4 and between the body 4 and the collar 2 eliminates any internal mounting structure that would obstruct the interior space 8 defined by body 4. The mounting arrangement eliminates a mounting structure that extends between the crown and the collar.

To make the finial, a body 4 having a first end with outer rim 44 and a second end with inner rim 46 is provided. The crown 6 is seated on the first end of the body such that outer rim 44 engages seat 86. The crown washer 100 is placed in abutting relationship with seat 108 on the outer rim 44. Where a multi-piece body is used, each of the pieces (4*a*-4*d*) is seated on the crown 6 to create the complete body 4. The fastener 120 is inserted from inside the finial through the crown washer 100 and is secured to the crown 6 to clamp the outer rim 44 of the body 4 between the crown washer 100 and the crown 6. The collar 2 is seated on the second end of the body 4 such that inner rim 46 engages seat 16. Collar washer 30 is placed in abutting relationship with the seat 62 on the inner rim 46. Where a multi-piece crown is used, the body 4 is seated on interior piece 2" and the outer piece 2' is seated on the inner piece 2". The fastener 70 is inserted from outside the finial through the collar 2 and secured to the collar washer 30 to clamp the inner rim 46 of the body 4 between the collar washer 30 and the collar 2. The finial may then be attached to a rod 12 using connector 79.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A finial comprising:

a body having a first end and a second end, at least a portion of said first end including a radially inwardly extending first ledge defining a first body seat, at least a portion of said second end including a radially inwardly extending second ledge defining a second body seat;

a collar washer positioned adjacent to said first ledge;

a collar attached to said first end using a first connector and said collar washer, said first connector configured to threadingly engage a portion of said collar washer, said first ledge of said body being secured between said collar washer and said collar when said first connector is coupled to said collar washer; and a crown attached to said second end using a second connector and a crown washer, said second connector configured to threadingly engage a portion of said crown, said second ledge of said body being secured between said crown washer and said crown when said second connector is coupled to said crown, said second connector being independent from said first connector;

wherein said body, said crown, and said collar define an interior space that is open and unobstructed between said crown and said collar.

2. The finial of claim 1, wherein said collar comprises an inner end that engages said body and an outer end that is adapted to be engaged by a rod.

3. The finial of claim 1, wherein:

said body comprises a see through structure; and said see through structure comprises at least one of an open framework, a transparent material or a translucent material.

4. The finial of claim 1, wherein said first and second ledges extend at least partially about an internal periphery of said body.

5. The finial of claim 1, wherein:

an aperture is defined through said collar washer; and said collar includes a post extending therefrom that is configured to be received within said aperture to prevent said collar washer from rotating relative to said collar.

6. The finial of claim 1 wherein said first connector threadingly engages said collar washer to secure said collar washer to said collar such that said first ledge is clamped between said collar and said collar washer.

7. The finial of claim 6, wherein:

said first connector comprises a first portion and a second portion;

said first portion comprising a first threaded member inserted through an aperture defined in said collar and threadably engaging a threaded hole of said collar washer such that said collar washer tightly clamps said body against said collar; and said second portion defines a connector that is adapted to engage a curtain rod to mount the finial to the curtain rod.

8. A finial comprising:

a body having a first end and a second end, said body including a first body portion at said first end and a second body portion at said second end;

a collar washer positioned adjacent to said first body portion;

a collar attached to said first end by a first connector and said collar washer, said first connector being configured to tighten said collar washer against said first body portion of said body such that said first body portion is trapped between said collar washer and said collar when said first connector is coupled to said collar washer; and a crown attached to said second end using a second connector and a crown washer, said second connector being configured to tighten said crown washer against said second body portion of said body such that said second body portion is trapped between said crown washer and said crown when said second connector is engaged with said crown washer, said second connector being independent from said first connector;

wherein said body, said crown, and said collar define an interior that is open and unobstructed between said first end of said body and said second end of said body.

9. The finial of claim 8, wherein said first connector comprises a first threaded member that threadably engages a female connector of said collar washer.

10. The finial of claim 8 wherein said second connector comprises a threaded member that thread ably engages a portion of said crown.

11. The finial of claim 8, wherein:

said first body portion corresponds to a radially inwardly extending first ledge disposed at said first end of said body; and said second body portion corresponds to a radially inwardly extending second ledge disposed at said second end of said body.

12. The finial of claim 11, wherein:

said first ledge defines a first body seat configured to engage said collar; and said second ledge defines a second body seat configured to engage said crown.

13. The finial of claim 8, wherein:

said collar defines a collar seat configured to engage a first rim of said body disposed at said first end; and said crown defines a crown seat configured to engage a second rim of said body disposed at said second end.

14. The finial of claim 1, wherein said first body seat forms an annular platform for supporting said collar washer relative to said collar.

15. The finial of claim 1, wherein said first connector corresponds to a first releasable connector and said second connector corresponds to a second releasable connector.

16. The finial of claim 1, wherein:

said first connector comprises a threaded member; and said collar washer defines a threaded hole configured to threadingly engage said threaded member.

17. The finial of claim 1, wherein said collar defines a collar seat configured to engage a rim of said body disposed at said first end.

18. The finial of claim 17, wherein:

said collar seat includes an external flange and a plurality of spaced apart internal flanges; and said rim includes a plurality of rim flanges configured to be positioned between said external flange and said internal flanges when said rim engages said collar seat.

19. The finial of claim 18, wherein:

said collar seat includes a transverse member extending radially outwardly from each of said internal flanges;

a transverse slot is defined between each pair of adjacent rim flanges; and said transverse member is received in said transverse slot when said rim engages said collar seat.

20. The finial of claim 1, wherein said crown defines a crown seat configured to engage a rim of said body disposed at said second end.

21. The finial of claim 20, wherein:

said crown seat includes an external flange and a plurality of spaced apart internal flanges; and said rim includes a plurality of rim flanges configured to be positioned between said external flange and said internal flanges when said rim engages said crown seat.

22. The finial of claim 21, wherein:

said crown seat includes a transverse member extending radially outwardly from each of said internal flanges;

a transverse slot is defined between each pair of adjacent rim flanges; and said transverse member is received in said transverse slot when said rim engages said crown seat.

* * * * *